US009211971B2

(12) United States Patent
Fogle et al.

(10) Patent No.: US 9,211,971 B2
(45) Date of Patent: Dec. 15, 2015

(54) CARTON WITH INSPECTION FEATURE

(71) Applicant: Graphic Packaging International, Inc., Atlanta, GA (US)

(72) Inventors: James C. Fogle, Marietta, GA (US); Li Wei Yang, Shanghai (CN)

(73) Assignee: Graphic Packaging International, Inc., Atlanta, GA (US)

( * ) Notice: Subject to any disclaimer, the term of this patent is extended or adjusted under 35 U.S.C. 154(b) by 105 days.

(21) Appl. No.: 13/894,673

(22) Filed: May 15, 2013

(65) Prior Publication Data

US 2013/0306716 A1 Nov. 21, 2013

Related U.S. Application Data

(60) Provisional application No. 61/688,653, filed on May 18, 2012.

(51) Int. Cl.
*B65D 5/42* (2006.01)
*B65D 71/36* (2006.01)

(52) U.S. Cl.
CPC ..... *B65D 5/4204* (2013.01); *B65D 71/36* (2013.01); *B65D 2571/0053* (2013.01); *B65D 2571/0066* (2013.01); *B65D 2571/00141* (2013.01); *B65D 2571/00444* (2013.01); *B65D 2571/00462* (2013.01); *B65D 2571/00561* (2013.01); *B65D 2571/00722* (2013.01); *B65D 2571/00845* (2013.01)

(58) Field of Classification Search
USPC ..... 229/162.3, 125.015, 117.11, 775, 229/162.6, 920, 117.22, 162.1, 162.2, 229/162.7; 206/782, 783, 773, 769, 775, 206/141, 200; 383/17; 493/905
See application file for complete search history.

(56) References Cited

U.S. PATENT DOCUMENTS

| | | | |
|---|---|---|---|
| 1,665,620 | A | 4/1928 | Amatel |
| 2,126,106 | A | 8/1938 | Goldberg |
| 2,643,811 | A | 6/1953 | Bolding |

(Continued)

FOREIGN PATENT DOCUMENTS

| | | |
|---|---|---|
| EP | 0 465 257 | 1/1992 |
| EP | 1 864 913 | 12/2007 |

(Continued)

OTHER PUBLICATIONS

International Search Report and Written Opinion for related application No. PCT/US2013/041099, mailed Aug. 26, 2013.

*Primary Examiner* — Christopher Demeree
(74) *Attorney, Agent, or Firm* — Womble Carlyle Sandridge & Rice, LLP

(57) ABSTRACT

A carton for carrying a plurality of articles. The carton comprises a plurality of panels for forming an interior of the carton. At least one of the plurality of panels has an inspection feature for inspecting at least one article of the plurality of articles. A carton for containing at least one article, the carton comprising a plurality of panels that extends at least partially around the interior of the carton, the plurality of panels comprising a top panel, a bottom panel, a first side panel, and a second side panel. A plurality of end flaps foldably connected to a respective panel of the plurality of panels. The plurality of end flaps being configured to at least partially close an end of the carton. At least one panel of the plurality of panels comprising at least one inspection feature for inspecting the at least one article.

27 Claims, 16 Drawing Sheets

(56) References Cited

U.S. PATENT DOCUMENTS

| | | | | |
|---|---|---|---|---|
| 2,872,093 | A * | 2/1959 | Chaplin | 229/406 |
| 3,070,222 | A | 12/1962 | Jones | |
| 3,257,028 | A | 6/1966 | Metzger | |
| 3,389,850 | A | 6/1968 | Rockefeller | |
| 3,428,235 | A * | 2/1969 | Randazzo | 206/427 |
| 3,679,093 | A | 7/1972 | Chang | |
| 4,166,570 | A * | 9/1979 | Lazerand et al. | 229/117.24 |
| 4,214,660 | A | 7/1980 | Hunt, Jr. | |
| 4,424,897 | A | 1/1984 | Ondris et al. | |
| 4,637,515 | A | 1/1987 | Wilson et al. | |
| 4,705,162 | A | 11/1987 | Kupersmit | |
| 4,865,187 | A | 9/1989 | Zulauf et al. | |
| 4,919,266 | A | 4/1990 | McIntosh, Jr. et al. | |
| 4,930,637 | A | 6/1990 | DeRoseau | |
| 5,018,663 | A * | 5/1991 | Corso | 229/117.13 |
| 5,060,852 | A | 10/1991 | Beckerman et al. | |
| 5,145,060 | A | 9/1992 | Maye | |
| 5,251,778 | A | 10/1993 | Eggl | |
| 5,375,700 | A | 12/1994 | Joss et al. | |
| 5,379,886 | A | 1/1995 | Brauner et al. | |
| 5,398,869 | A | 3/1995 | Dickson et al. | |
| 5,520,325 | A | 5/1996 | Quaintance | |
| 5,551,556 | A | 9/1996 | Sutherland | |
| 5,566,878 | A | 10/1996 | Peiffer et al. | |
| 5,607,058 | A | 3/1997 | Huesman et al. | |
| 5,730,353 | A | 3/1998 | Holley, Jr. | |
| D408,731 | S | 4/1999 | Taylor et al. | |
| 5,907,944 | A | 6/1999 | Giacoman | |
| 6,173,833 | B1 | 1/2001 | Strehlow | |
| 6,206,750 | B1 | 3/2001 | Barad et al. | |
| 6,237,777 | B1 | 5/2001 | Bierly | |
| 6,241,083 | B1 | 6/2001 | Harrelson | |
| 6,298,990 | B1 | 10/2001 | Amrod et al. | |
| 6,470,653 | B1 | 10/2002 | Lutz et al. | |
| 6,474,539 | B1 | 11/2002 | Van Der Horst | |
| 6,679,029 | B2 | 1/2004 | Clay | |
| 6,802,415 | B2 | 10/2004 | Loeffler | |
| 6,823,988 | B2 | 11/2004 | Ryan et al. | |
| 7,581,644 | B2 | 9/2009 | Wright | |
| 7,584,854 | B2 | 9/2009 | Chandaria | |
| 7,874,430 | B2 | 1/2011 | Anderson et al. | |
| 2002/0066778 | A1 | 6/2002 | Heeley et al. | |
| 2002/0088730 | A1 | 7/2002 | Galomb | |
| 2004/0104263 | A1 | 6/2004 | Keay et al. | |
| 2004/0163986 | A1 | 8/2004 | Pinyot | |
| 2005/0247767 | A1 * | 11/2005 | Smalley | 229/117.13 |
| 2010/0065618 | A1 | 3/2010 | Lechevalier et al. | |
| 2011/0101078 | A1 | 5/2011 | Requena et al. | |
| 2012/0037692 | A1 | 2/2012 | Fitzwater | |

FOREIGN PATENT DOCUMENTS

| | | |
|---|---|---|
| EP | 2 308 762 | 4/2011 |
| FR | 2 853 886 | 10/2004 |

* cited by examiner

CARTON WITH INSPECTION FEATURE

CROSS-REFERENCE TO RELATED APPLICATION

This application claims the benefit of U.S. Provisional Patent Application No. 61/688,653, filed May 18, 2012.

INCORPORATION BY REFERENCE

The disclosure of U.S. Provisional Patent Application No. 61/688,653, which was filed May 18, 2012, is incorporated by reference as if presented herein in their entirety, for all purposes.

BACKGROUND OF THE DISCLOSURE

The present disclosure generally relates to cartons or carriers for holding beverage containers or other types of articles. More specifically, the present disclosure relates to cartons with inspection features that allow visual and tactile inspection of the containers or articles.

SUMMARY OF THE DISCLOSURE

In general, one aspect of the disclosure is directed to a carton for containing at least one article. The carton comprises a plurality of panels that extends at least partially around the interior of the carton. The plurality of panels comprises a top panel, a bottom panel, a first side panel, and a second side panel. A plurality of end flaps is foldably connected to a respective panel of the plurality of panels. The plurality of end flaps is configured to at least partially close an end of the carton. At least one panel of the plurality of panels comprises at least one inspection feature for inspecting the at least one article.

In another aspect, the disclosure is generally directed to a blank for forming a carton for containing at least one article. The blank comprising a plurality of panels for forming an interior of a carton formed from the blank. The plurality of panels comprising a top panel, a bottom panel, a first side panel, and a second side panel. A plurality of end flaps is foldably connected to a respective panel of the plurality of panels. The plurality of end flaps is configured to at least partially close an end of the carton formed from the blank. At least one panel of the plurality of panels comprises at least one inspection feature for inspecting the at least one article.

In another aspect, the disclosure is generally directed to a method of forming a carton. The method comprises obtaining a blank comprising a plurality of panels comprising a top panel, a bottom panel, a first side panel, and a second side panel. At least one panel of the plurality of panels comprises at least one inspection feature for inspecting the at least one article. The method comprises positioning the plurality of panels to at least partially form an interior of the carton. The method comprises obtaining at least one article; placing the at least one article in the interior of the carton, and positioning the at least one article for inspection through the at least one inspection feature.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons, cartons, packages, containers, etc., that contain articles such as containers, bottles, cans, boxes, etc. The articles can be used for packaging food and beverage products, for example. The articles can be made from materials suitable in composition for packaging the particular food or beverage item, and the materials include, but are not limited to, paperboard, composite paperboard and plastic, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., brick-shaped containers) as disposed within the carton embodiments. In this specification, the terms "lower," "bottom," "upper" and "top" indicate orientations determined in relation to fully erected and upright cartons.

Figure 1:
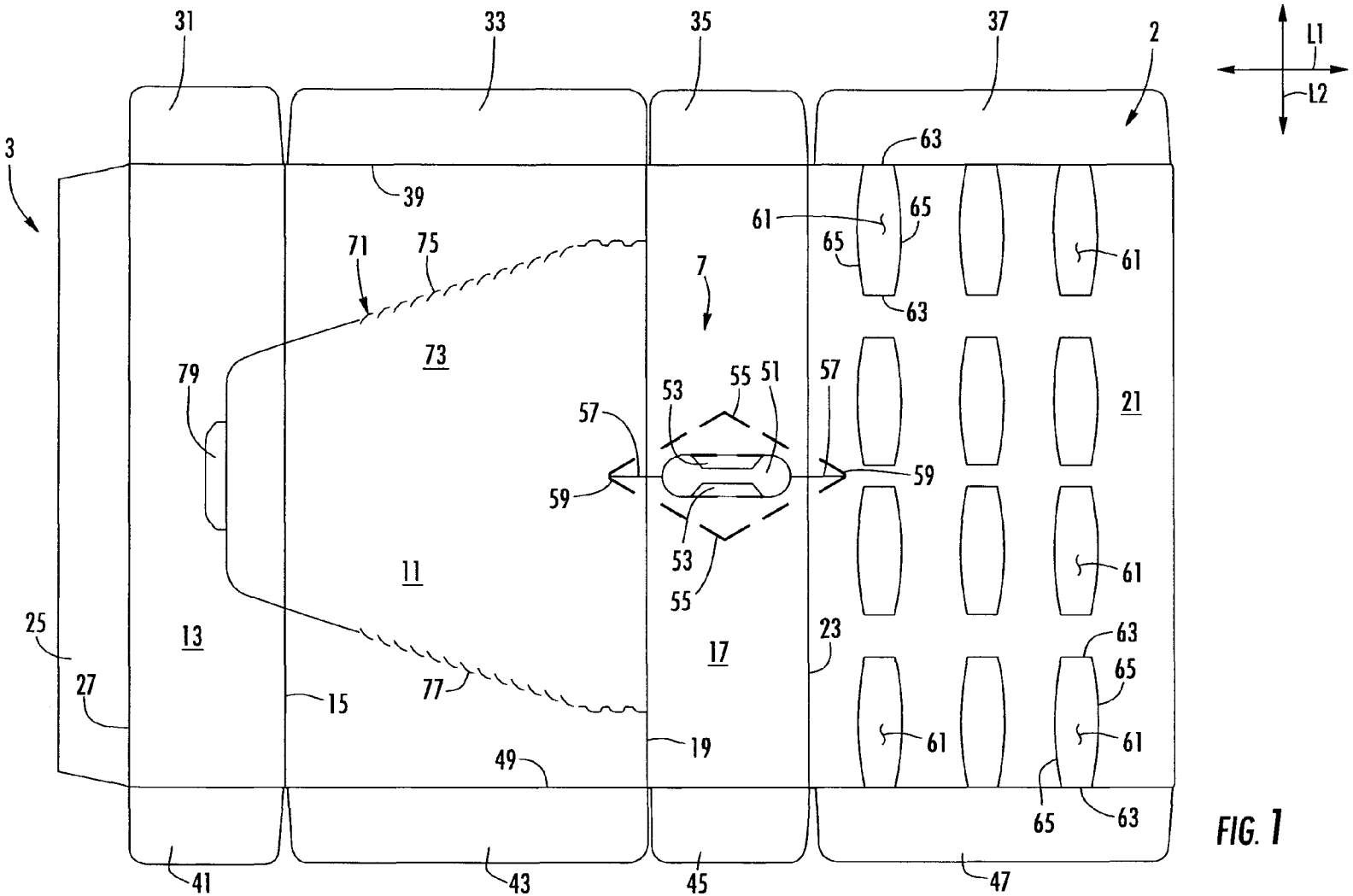
FIG. 1 is a plan view of the exterior surface of a blank for forming a carton according to a first embodiment of the disclosure.

FIG. 1 is a plan view of an exterior surface 2 of a blank 3, used to form a carton 5, shown in FIGS. 2-5, according to one embodiment of the disclosure. The carton 5 can be used to house a plurality of articles such as containers C. In one embodiment, the containers C can be brick-shaped containers commonly referred to as TETRA PAK© containers that contain a liquid beverage or other food or beverage product. The containers C can be any suitable container such as any shape, size, and type of container that is commercially available from Tetra Pak International SA, Lausanne, Switzerland, such as TETRA BRIK packages, TETRA BRIK ASEPTIC packages, TETRA PRISM ASEPTIC packages, or any other suitable package or container (see www.tetrapak.com for more information). The containers C could be other suitable containers made from other materials by other manufactures (e.g., PET bottles, yogurt containers, juice-boxes, beverage cans, etc.) without departing form the disclosure.

In one embodiment, the blank 3 is sized to form a carton 5 that contains twenty-four containers C or packages in a single layer in a 3×8 arrangement. But, it is understood that the blank 3 and/or carton 5 may be sized and shaped to hold containers C of a different or same quantity in more than one layer and/or in different row/column arrangements (e.g., 1×6, 2×3, 2×6, 2×4, 3×4, 3×6, 2×2, 2×6×2, 2×4×2, 2×9, etc.). In the illustrated embodiment, the carton 5 has at least partially closed ends 6, 8 and inspection features that allow visual and tactile inspection of the containers C.

As shown in FIG. 1, the blank 3 has a longitudinal axis L1 and a lateral axis L2. In the illustrated embodiment, the blank 3 comprises a bottom panel 11 foldably connected to a first side panel 13 at a lateral fold line 15, a second side panel 17 foldably connected to the bottom panel at a lateral fold line 19, a top panel 21 foldably connected to the second side panel at a lateral fold line 23, and an adhesive flap 25 foldably connected to the first side panel 13 at a lateral fold line 27.

In one embodiment, the panels 11, 13, 17, 21 have respective first end flaps 31, 33, 35, 37 at a first marginal portion of the blank 3 such that the first end flaps are foldably connected to respective panels by a longitudinal fold line 39. The panels 11, 13, 17, 21 have respective second end flaps 41, 43, 45, 47 at a second marginal portion of the blank 3 such that the second end flaps are foldably connected to respective panels by a longitudinal fold line 49. The first end flaps 31, 33, 35, 37 are for closing the first end 6 of the carton 5 and the second end flaps 41, 43, 45, 47 are for closing the second end 8 of the carton. In alternative embodiments, one or more of the first end flaps 31, 33, 35, 37 and second end flaps 41, 43, 45, 47 can be foldably connected to each other at respective fold lines, can be configured to provide at least partially open ends 6, 8, or one or more of the end flaps can have respective gussets or webs foldably connecting adjacent first or second end flaps or one or more of the end flaps can be tuck-in panels or flaps without departing from the disclosure. The end flaps could be otherwise shaped, arranged, configured, and/or omitted without departing from the disclosure.

In one embodiment, the second side panel 17 includes handle features for forming a handle 7 of the carton 5. As shown in FIG. 1, the handle features comprise an elongate opening 51 in the side panel 17 and foldable flaps 53 adjacent the elongate opening. The handle 7 further includes stress-relieving fold lines 55 in the side panel 17, tear lines 57 extending from the elongate opening 51 into the bottom panel 11 and top panel 21, and tear-stop fold lines 59 in a respective top and bottom panel. The handle 7 and features forming the handle could be otherwise shaped, arranged, configured, or omitted without departing from the disclosure. Further, the handle 7 could be completely omitted form the carton 5 without departing from the disclosure.

In the embodiment of FIG. 1, the blank 3 includes inspection features in the form of elongate openings 61 in the top panel. In one embodiment, the top panel 21 includes twelve elongate openings 61 arranged in a 3×4 arrangement, but more or less than twelve openings could be provided and the openings could be otherwise arranged without departing from the disclosure. In one embodiment, each of the elongate openings have two straight end edges 63 and two curved edges 65 extending laterally between the end edges 63. The elongate openings 61 are sized such that at least two containers C may be inspected through each opening. The elongate openings 61 could be otherwise shaped without departing from the disclosure.

In one exemplary method of forming the blank 3 into the carton 5, the blank is first placed with the interior surface facing up and containers C are placed on the bottom panel 11 with the bottoms of the containers in contact with the bottom panel. Prior to or after placing the containers C on the bottom panel 11, the side panels 13, 17 can be upwardly folded relative to the bottom panel and the top panel 21 can be positioned to be in contact with the tops of the containers C. The glue flap 25 can be adhesively attached to the interior surface of the top panel 21. The end flaps 31, 33, 35, 37 can be positioned to be at least partially overlapped to close the first end 6 and the end flaps 41, 43, 45, 47 can be at least partially overlapped to close the second end 8. Alternatively, the carton 5 can be formed by other positioning steps. In one alternative embodiment, the panels 11, 13, 17, 21 can be positioned to form and open-end sleeve, with the containers being loaded into the open-ended sleeve prior to closing one or both of the ends 6, 8.

Figure 2:
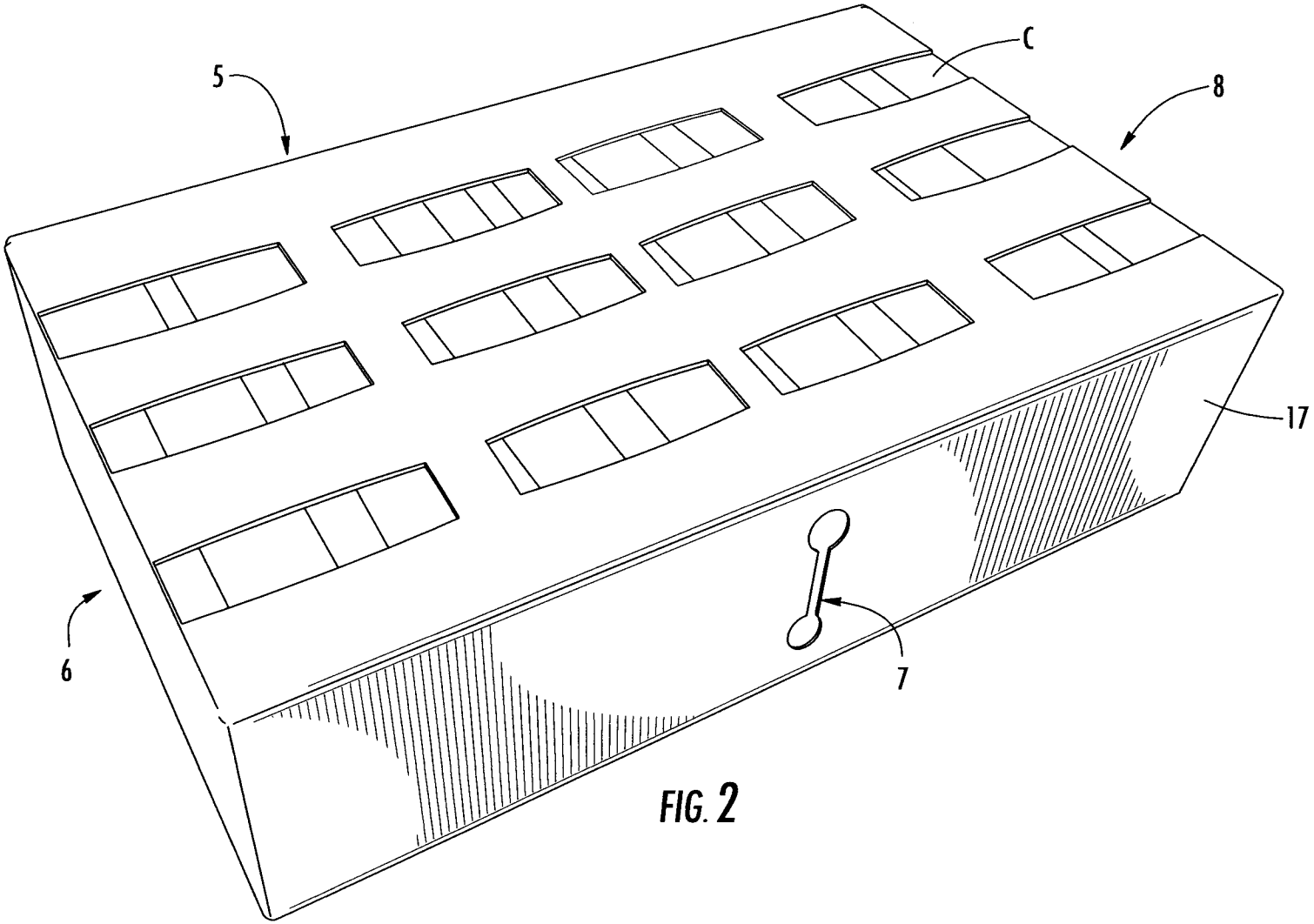
FIGS. 2-3 are perspective views of the assembled carton of the first embodiment formed from the blank of FIG. 1.
Figure 3:
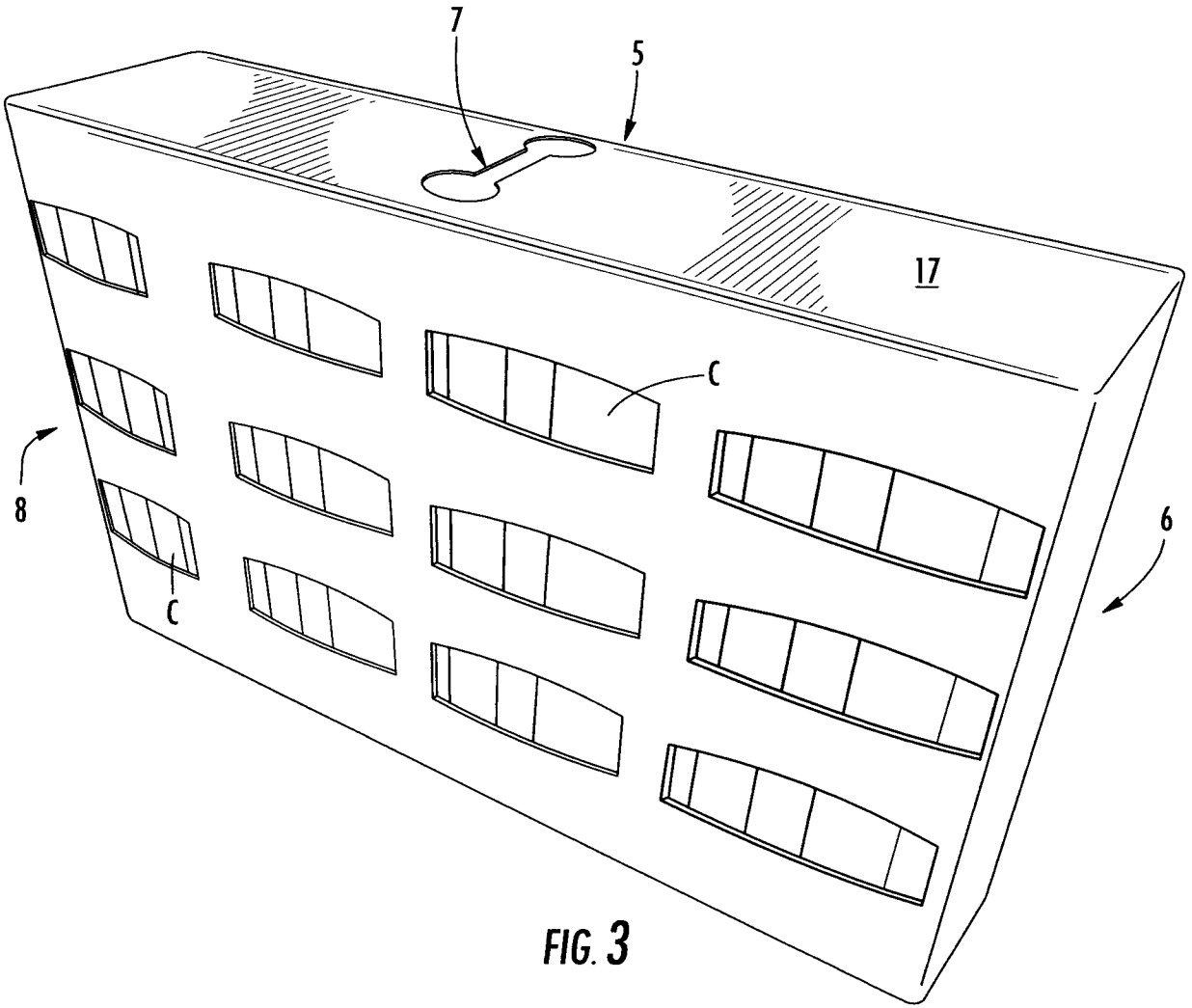

As shown in FIGS. 2-3 the inspection openings 61 in the top panel 21 allow visual inspection of the containers C in the carton 5 to check that the carton 5 has been fully loaded with the required amount of containers C. Also, the inspection openings 61 allow human or automated tactile inspection to check that the required amount of containers C are loaded in the carton 5. A human operator can touch and count each container, or a packaging machine or other mechanism can be used to detect the location of each container C through the inspection openings 61 in the top panel 21. The inspection openings 61 allow inspection of the containers C without tearing, weakening, or disturbing the integrity of the carton 5.

Figure 4:
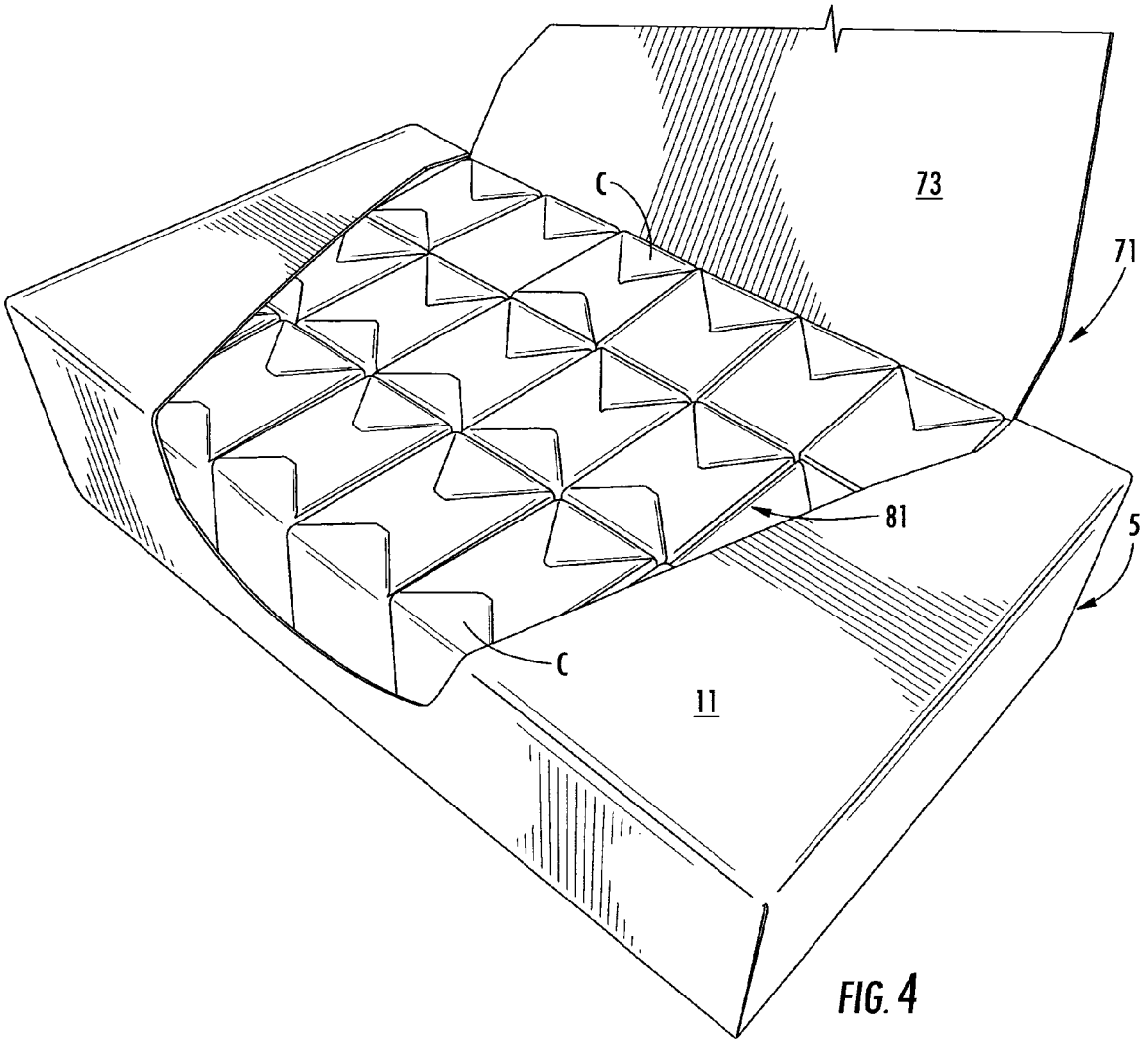
FIG. 4 is a perspective view of the assembled carton of the first embodiment formed from the blank of FIG. 1 with the dispenser panel partially torn.

As shown in FIGS. 1 and 4, the blank 3 has features for forming a dispenser 71 in the carton 5. The dispenser 71 comprises a dispenser panel 73 in the bottom panel 11 and the first side panel 13. The dispenser panel 73 is at least partially defined by two tear lines 75, 77 extending from the lateral fold line 19 to an access flap 79 in the first side panel 13. The dispenser 71 could be otherwise shaped, arranged, configured, and/or omitted without departing from the disclosure. The dispenser 71 can be activated to access the containers C by grasping the access flap 79 and tearing along the tear lines 75, 77 to at least partially remove the dispenser panel 73 to create a dispenser opening 81 for accessing the containers. The dispenser panel 73 can remain foldably connected to the carton 5 at the fold line 19, or the dispenser panel can be completely removed without departing from the disclosure.

Figure 5:
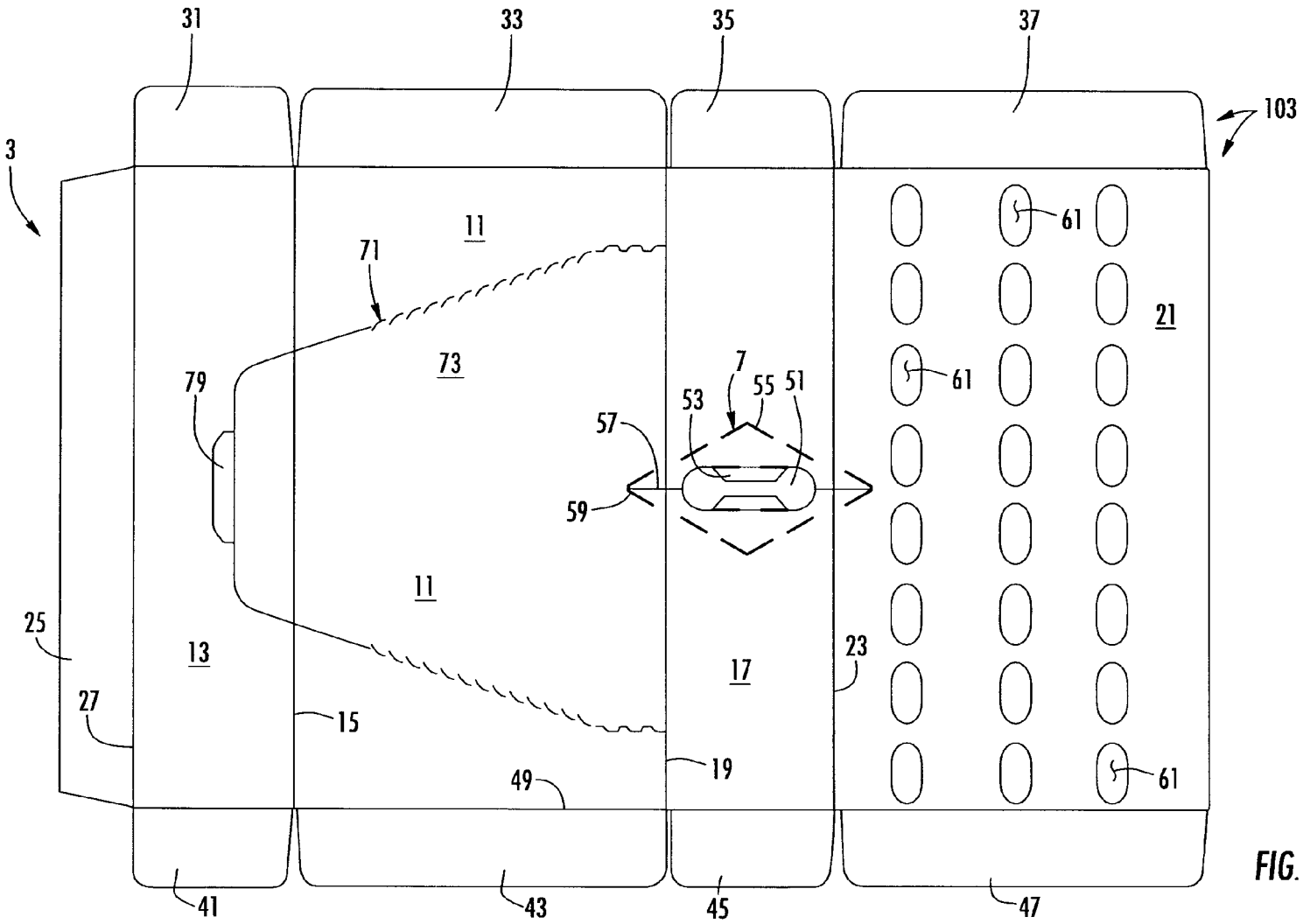
FIG. 5 is a plan view of the exterior surface of a blank for forming a carton according to a second embodiment of the disclosure.
Figure 6:
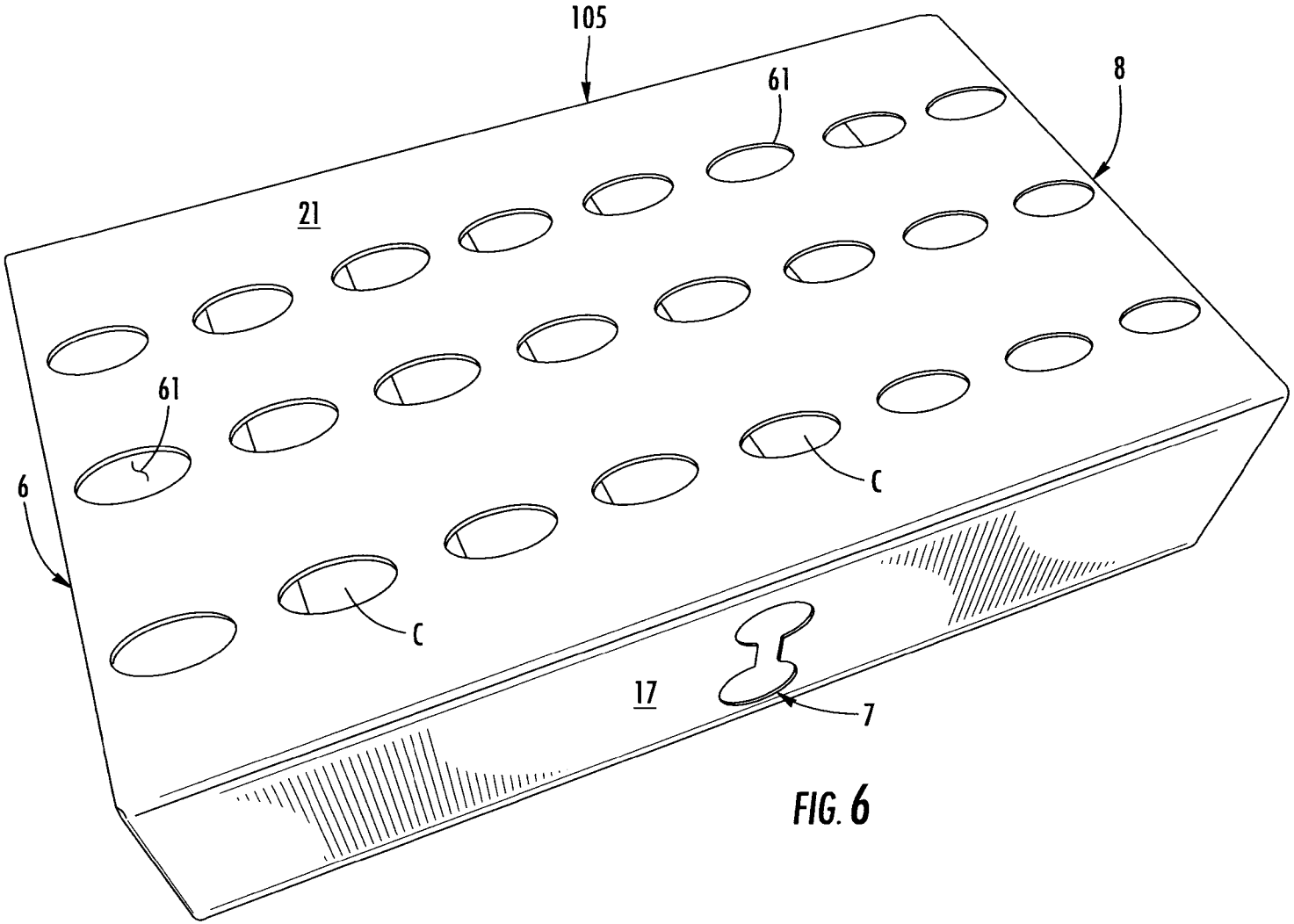
FIGS. 6-7 are perspective views of the assembled carton of the second embodiment formed from the blank of FIG. 5.
Figure 7:
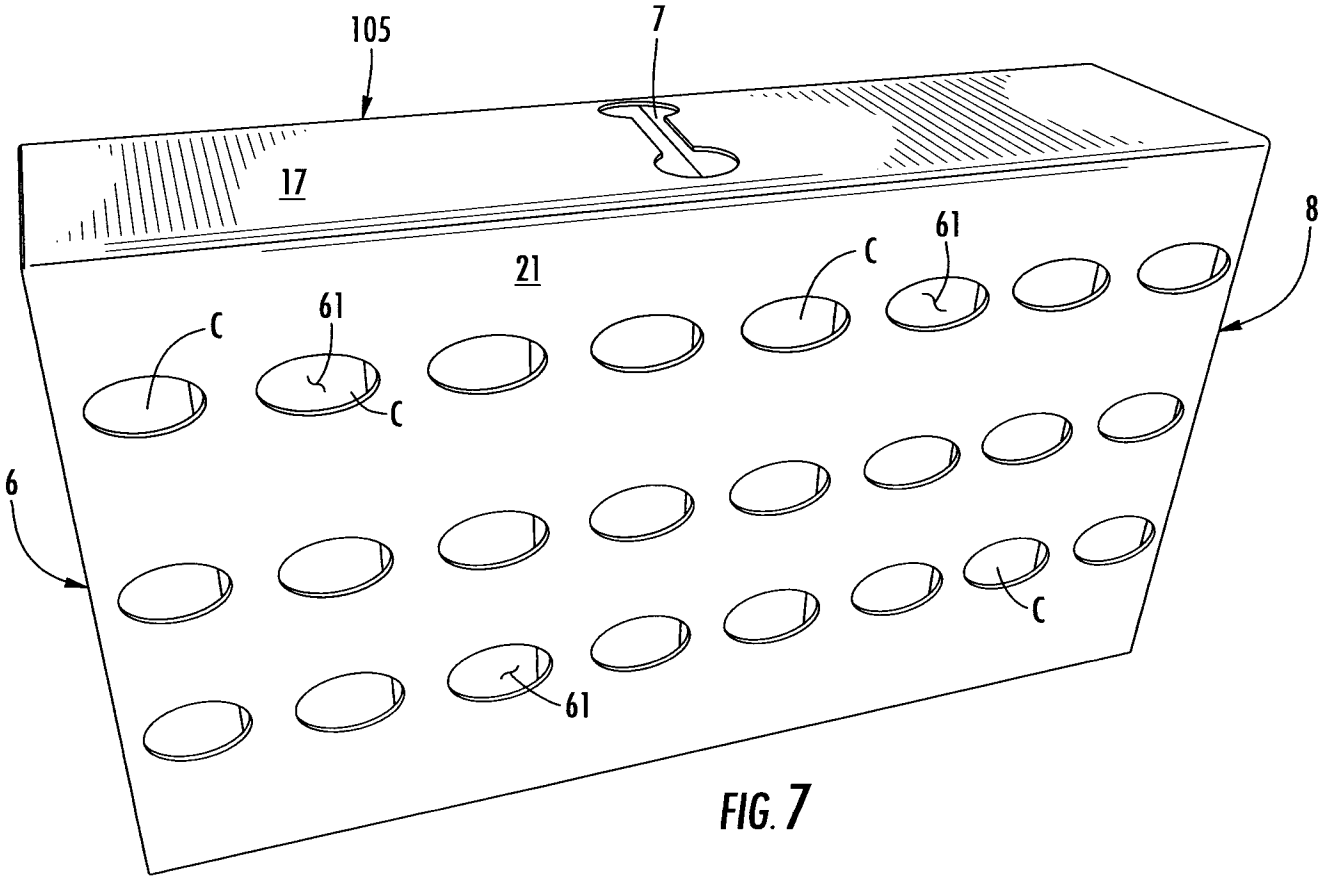

FIGS. 5-7 show a blank 103 for forming a carton 105 of a second embodiment of the disclosure having similar features as the first embodiment. Accordingly, similar or identical features of the embodiments are provided with identical or similar reference numbers. The blank 103 includes a top panel 21 having generally oval-shaped inspection openings 61. In the second embodiment, twenty-four inspection openings 61 are provided so that each container C has a respective inspection opening. In the second embodiment, the inspection openings 61 are arranged in a 3×8 arrangement, but the openings could be otherwise shaped, arranged, and/or configured without departing from the disclosure.

Figure 8:
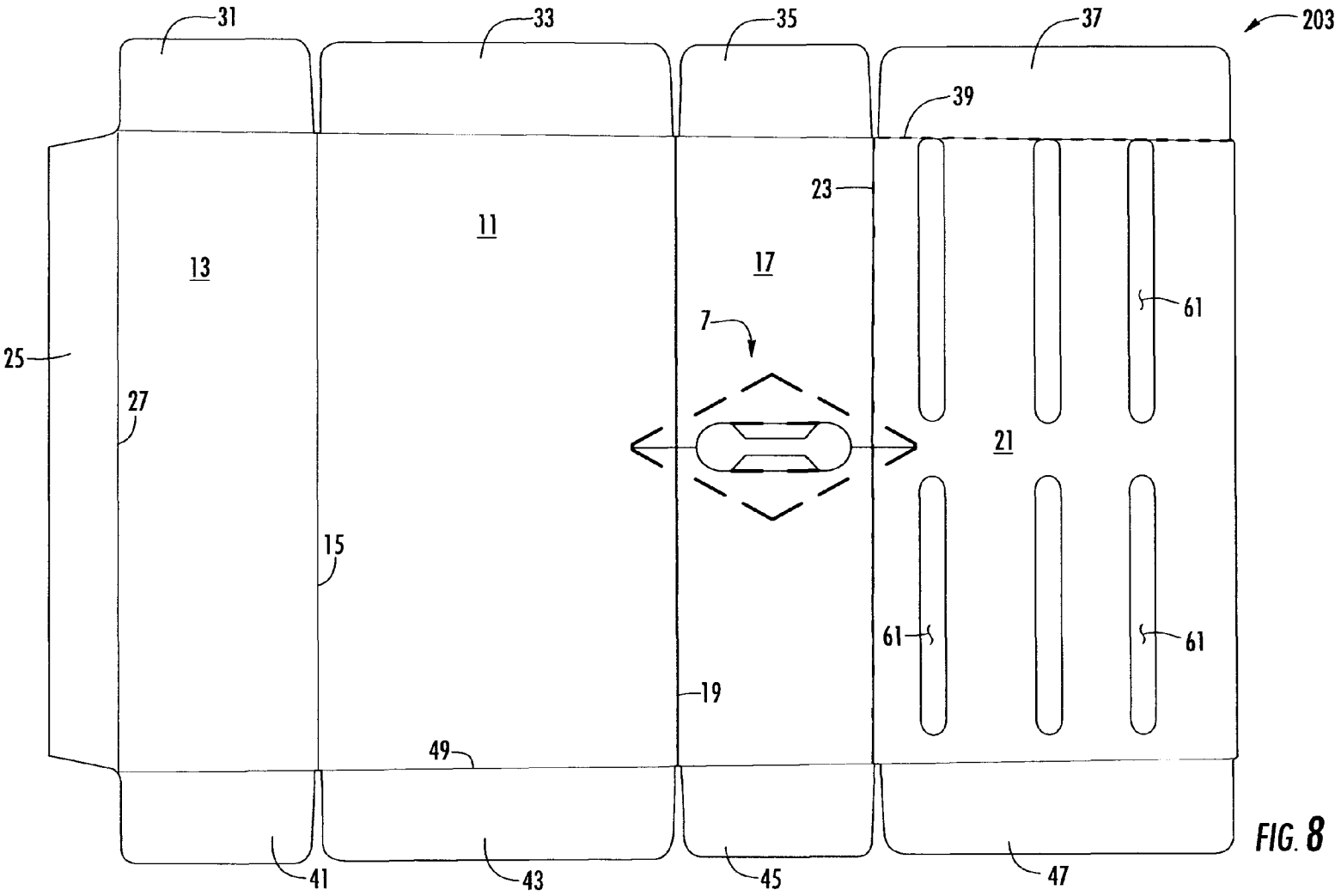
FIG. 8. is plan view of the exterior surface of a blank for forming a carton according to a third embodiment of the disclosure.
Figure 9:
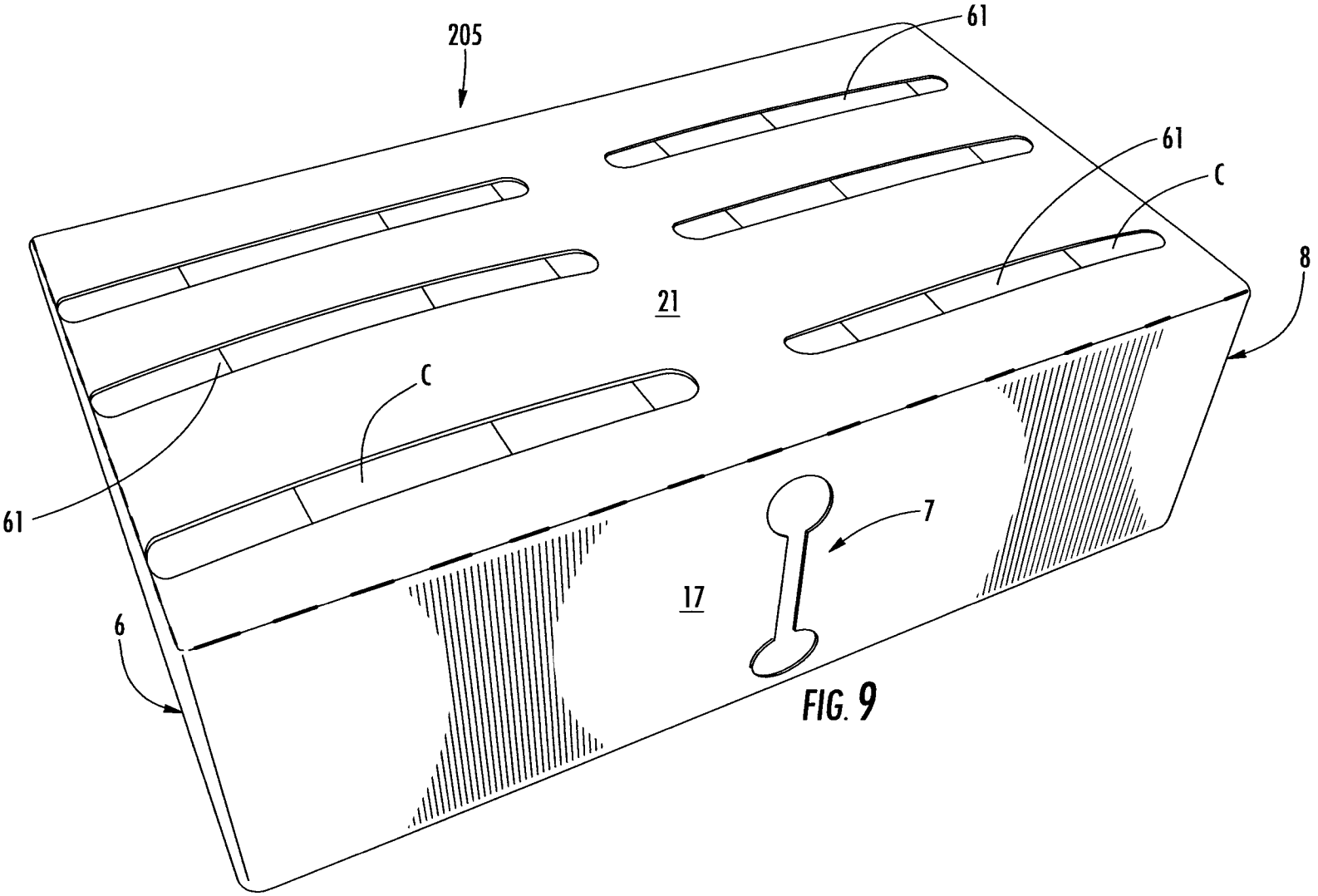
FIGS. 9-10. are perspective views of the assembled carton of the third embodiment formed from the blank of FIG. 8.
Figure 10:
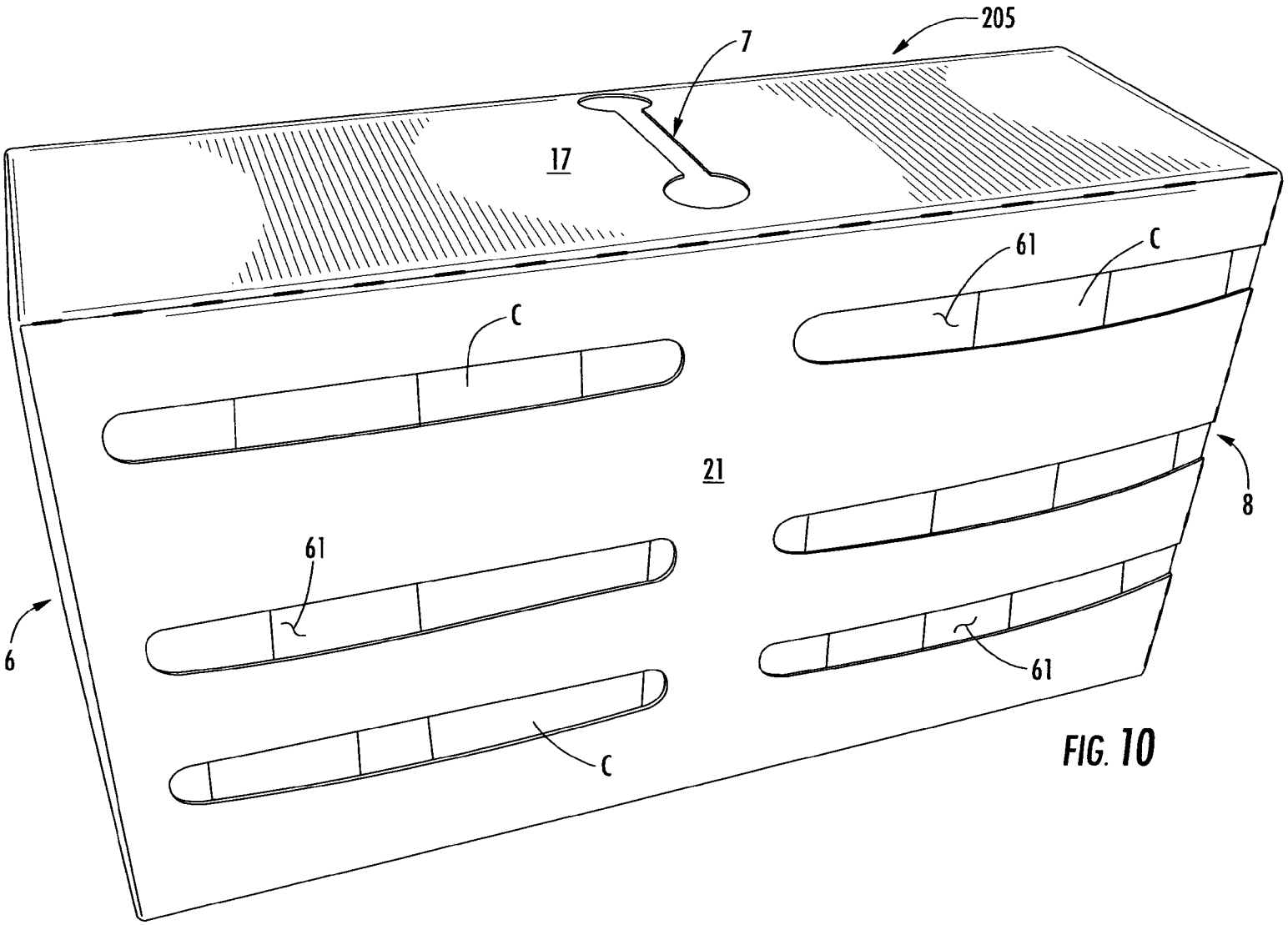

FIGS. 8-10 show a blank 203 for forming a carton 205 of a third embodiment of the disclosure having similar features as the first embodiment. Accordingly, similar or identical features of the embodiments are provided with identical or similar reference numbers. The blank 203 includes a top panel 21 having elongate inspection openings 61 that are each sized to extend across approximately half the length of the top panel. In the third embodiment, six inspection openings 61 are provided and are arranged in a 3×2 arrangement. The elongate openings 61 are sized such that four containers C may be inspected through the opening. Three of the inspection openings extend to the edge of the top panel 21 along fold line 39. The fold lines 23 and 39 may comprise a series of spaced apart cuts and nicks, but the openings could be otherwise shaped, arranged, and/or configured without departing from the disclosure.

Figure 11:
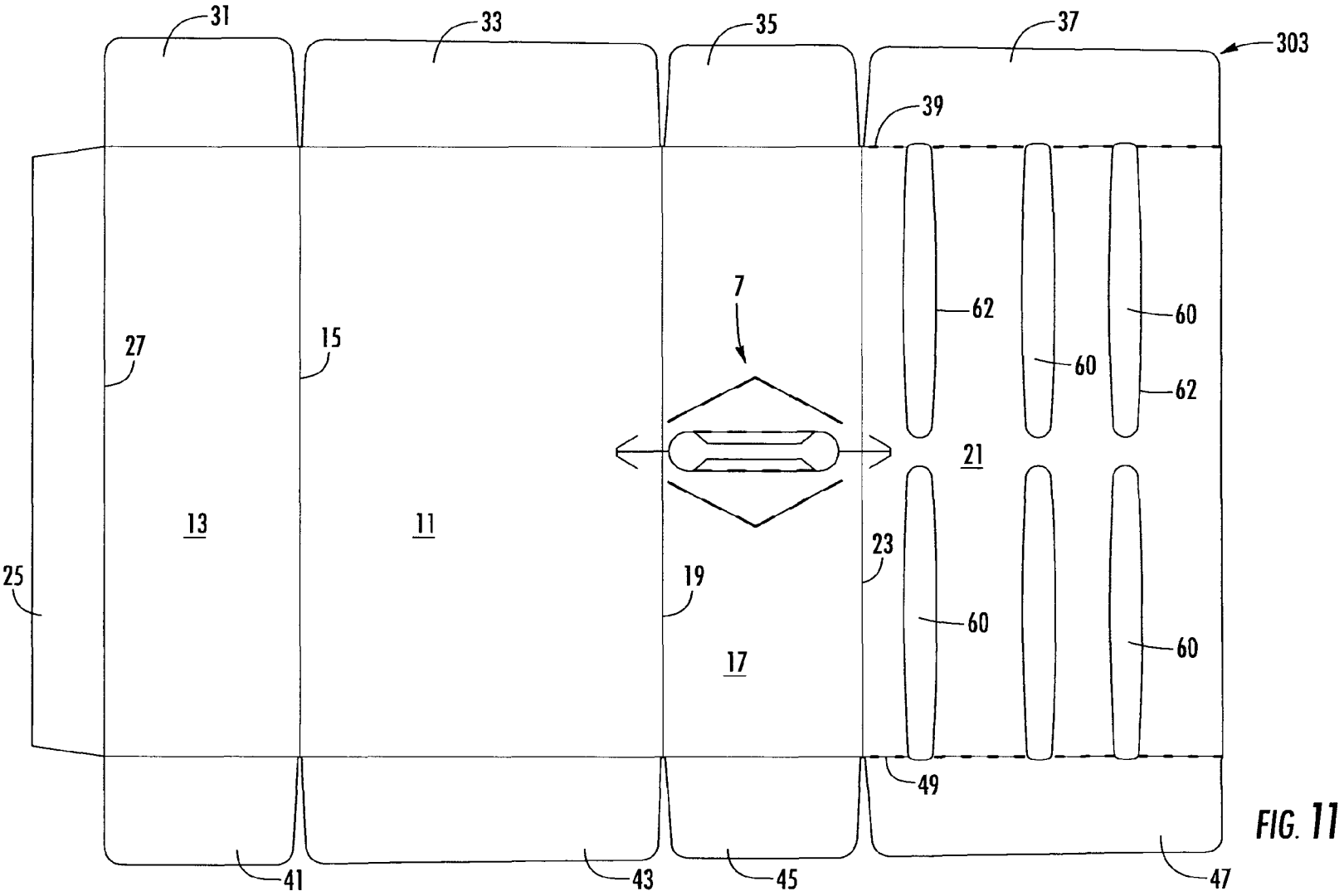
FIG. 11 is a plan view of the exterior surface of a blank for forming a carton according to a fourth embodiment of the disclosure.
Figure 12:
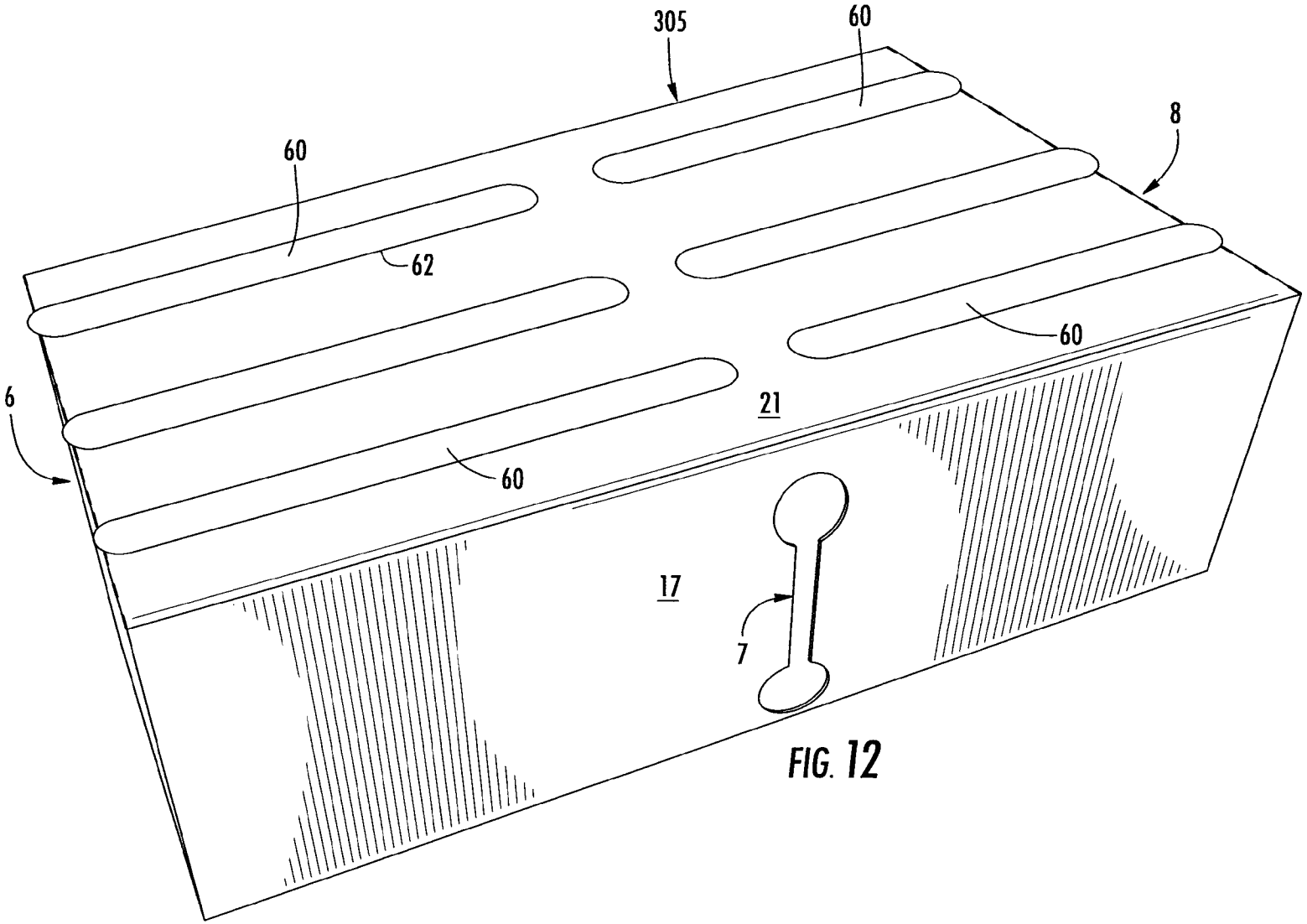
FIGS. 12-13 are perspective views of the assembled carton of the fourth embodiment formed from the blank of FIG. 11.
Figure 13:
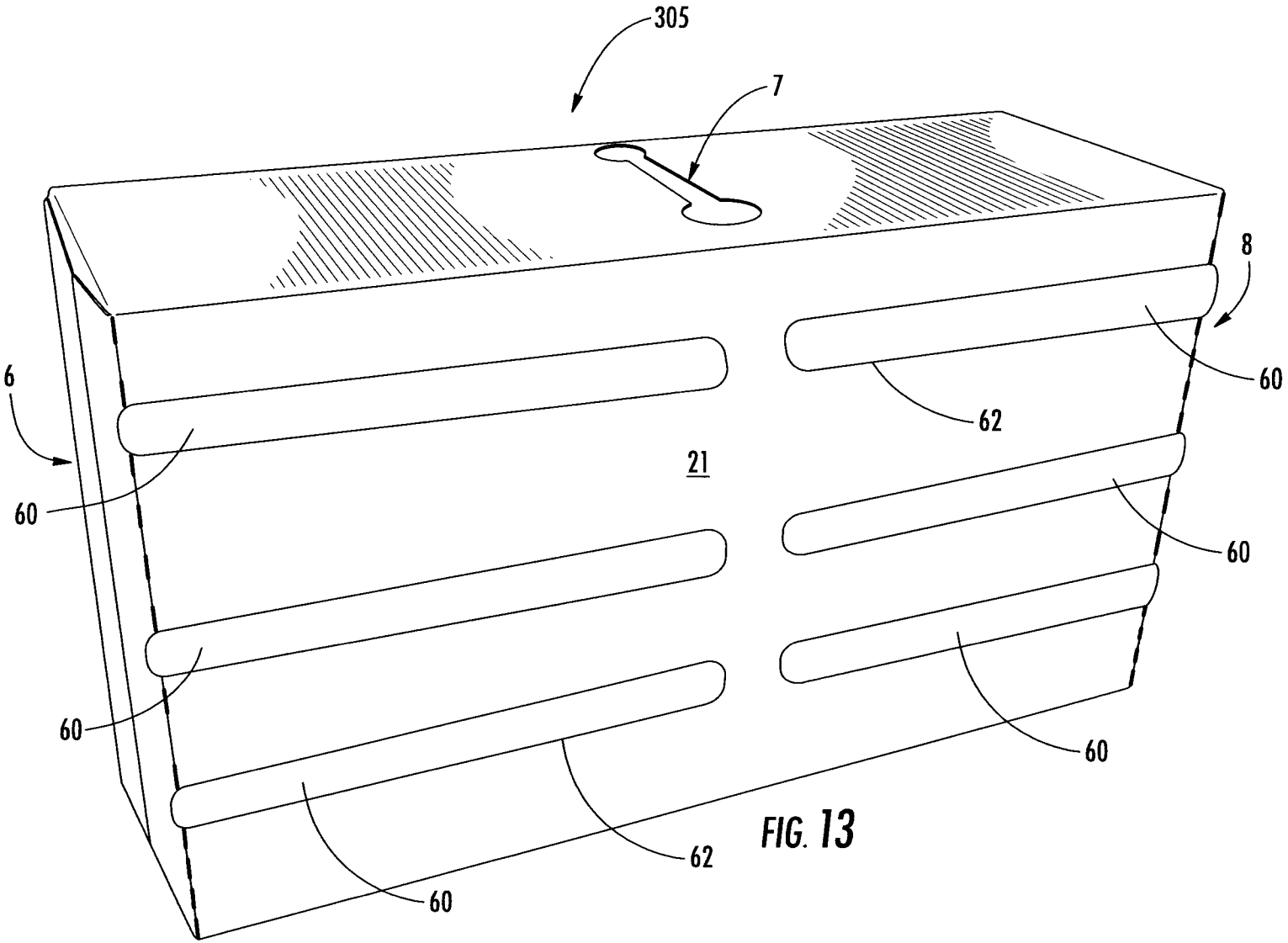

FIGS. 11-13 show a blank 303 for forming a carton 305 of a fourth embodiment of the disclosure having similar features as the first embodiment. Accordingly, similar or identical features of the embodiments are provided with identical or similar reference numbers. The blank 303 includes a top panel 21 having inspection features in the form of removable panels 60 that are similarly shaped as the elongate inspection openings 61 of the third embodiment. The panels 60 are removably attached to the top panel 21 at a respective tear line 62 that can be a series of spaced apart cuts and nicks, or any other feature that promotes tearing and removal of the panels 60. In one embodiment, the removable panels 60 extend beyond the longitudinal fold lines 39, 49 connecting the respective end flaps 37, 47 to the top panel 21. The fold lines 39 and 49 may comprise a series of spaced apart cuts and nicks. In the fourth embodiment, six removable panels 60 are provided and are arranged in a 3×2 arrangement, but the panels could be otherwise shaped, arranged, and/or configured without departing from the disclosure. Further, the removable panels 60 could be alternatively arranged so that three panels are provided with one or more of the panels extending across the length of the top panel 21 without departing from the disclosure.

Figure 14:
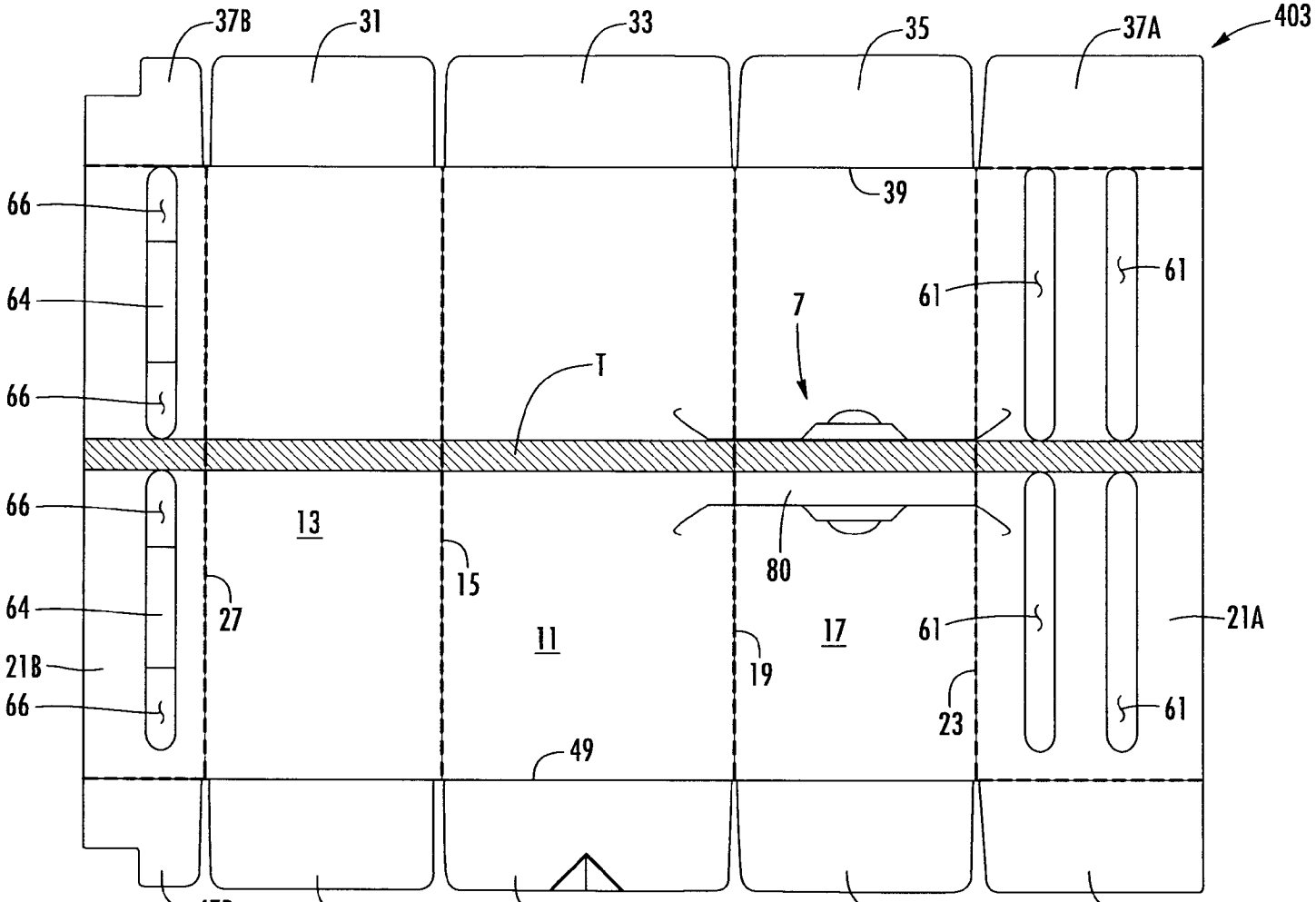
FIG. 14 is a plan view of the exterior surface of a blank for forming a carton according to a fifth embodiment of the disclosure.
Figure 15:
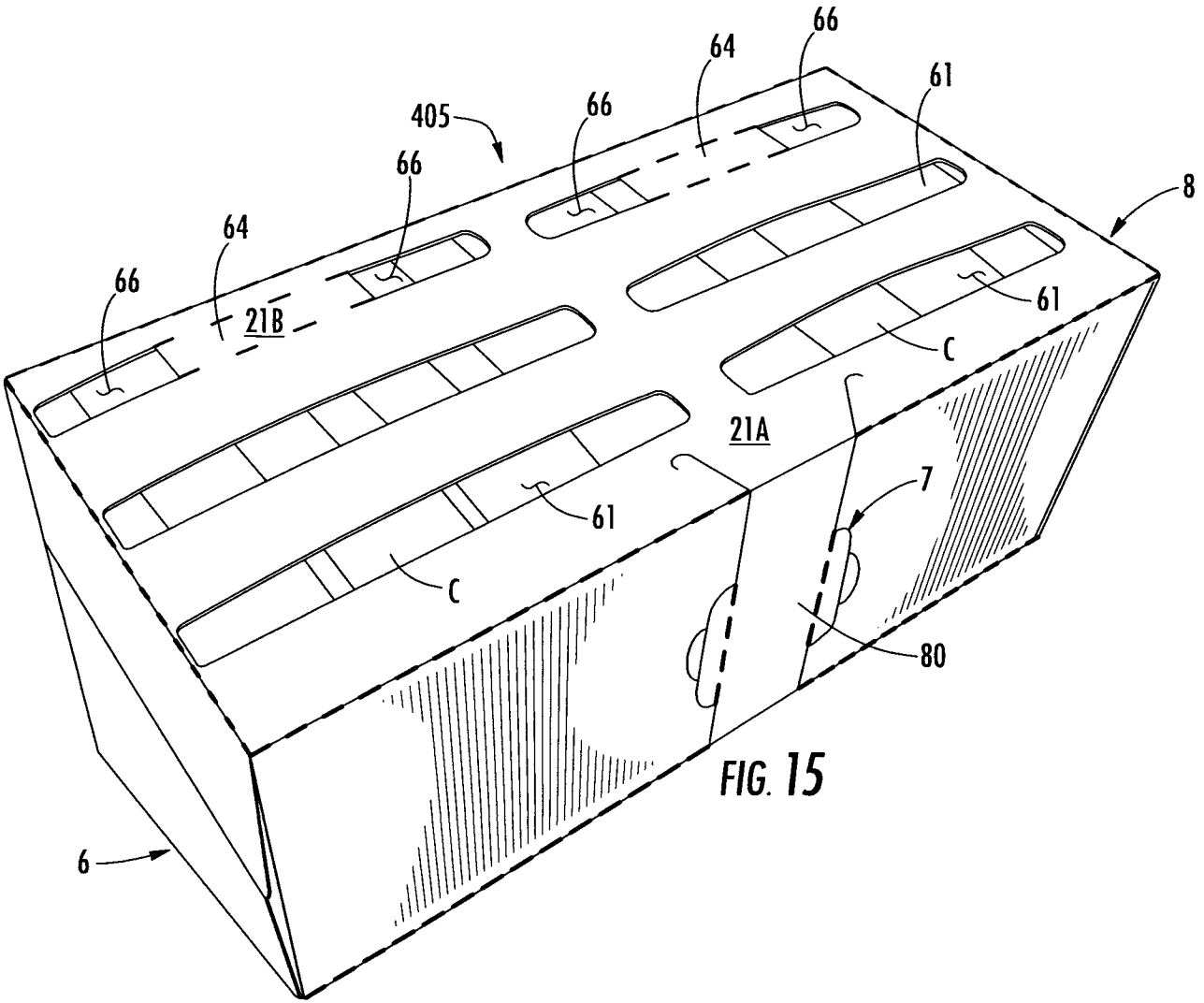
FIGS. 15-16 are perspective views of the assembled carton of the fourth embodiment formed from the blank of FIG. 14.
Figure 16:
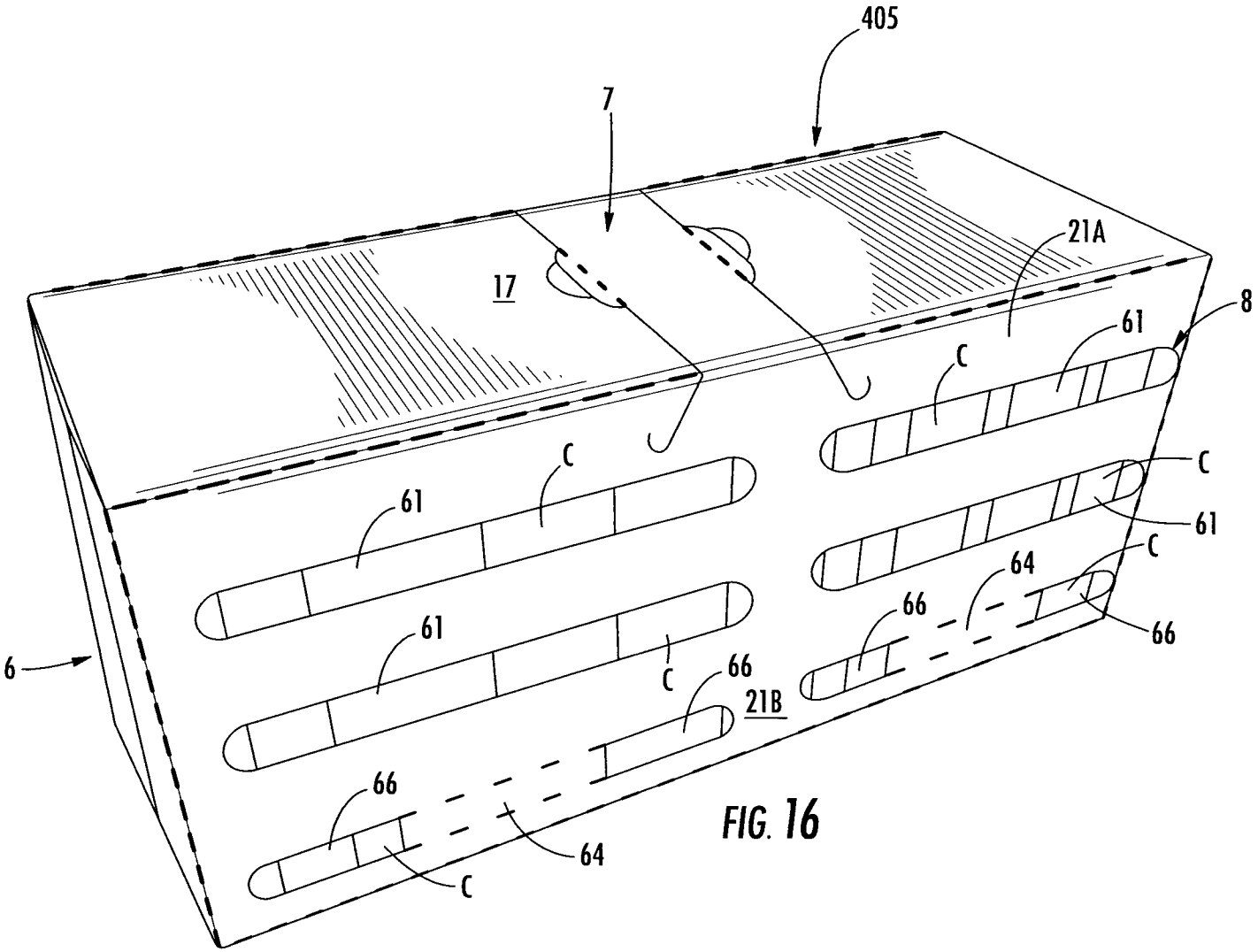

FIGS. 14-16 show a blank 403 for forming a carton 405 of a fifth embodiment of the disclosure having similar features as the fourth embodiment. Accordingly, similar or identical features of the embodiments are provided with identical or similar reference numbers. The blank 403 includes a first top panel 21A having inspection features in the form of elongate openings 61 similar to the elongate openings 61 of the third embodiment. The blank 403 has a second top panel 21B that cooperates with the first top panel 21A to form the top panel of the carton 405. The second top panel 21B includes inspection features in the form of two inspection panels 64 with an inspection opening 66 adjacent a respective end of an inspection panel. As with the previous embodiment, the inspection panels 64 can be removed from the second top panel 21B or the inspection panels can remain attached to the second top panel in the carton 405 formed from the blank 403. The handle 7 and features of the blank 403 forming the handle 7 have been modified from the handle of the first embodiment. In the fifth embodiment, the handle 7 includes a handle panel 80 in the side panel 17 and extending into the bottom panel 11 and the first top panel 21A. Further, the handle 7 and the carton 405 are reinforced by the reinforcing tape T that extends across the length of the blank 403 and is applied to the handle panel 80.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing at least one article, the carton comprising:

a plurality of panels that extends at least partially around an interior of the carton, the plurality of panels comprising a top panel, a bottom panel, a first side panel, and a second side panel;

a plurality of end flaps foldably connected to a respective panel of the plurality of panels, the plurality of end flaps being configured to at least partially close an end of the carton; and at least one panel of the plurality of panels comprising a plurality of inspection features for inspecting the at least one article, the plurality of inspection features comprises six inspection features arranged in a 3×2 arrangement, and the plurality of inspection features are each sized to extend laterally across approximately half of the at least one panel; and wherein at least one inspection feature comprises a removable inspection panel and inspection openings adjacent respective ends of the inspection panel and the top panel comprises a first top panel and a second top panel, the plurality of inspection features being in the second top panel.

2. The carton of claim 1, wherein the plurality of inspection features comprises at least one opening in the at least one panel, the at least one opening is positioned relative to the at least one article to allow visual and tactile inspection of the at least one article.

3. The carton of claim 2, wherein the at least one article comprises a plurality of articles, the plurality of inspection features are for inspecting at least two articles of the plurality of articles.

4. The carton of claim 3, wherein plurality of inspection features are for inspecting at least four of the plurality of articles.

5. The carton of claim 1, wherein the top panel comprises the plurality of inspection features.

6. The carton of claim 5, wherein the plurality of inspection features comprises a plurality of removable panels removably attached to the top panel at a respective tear line.

7. The carton of claim 6, wherein the plurality of end flaps comprises a first top end flap and a second top end flap, the first top end flap is foldably connected to the top panel along a first fold line, the second top end flap is foldably connected to the top panel along a second fold line; and the plurality of removable panels extend beyond the first fold line and the second fold line.

8. The carton of claim 1, wherein the plurality of inspection features comprises an inspection opening in the first top panel.

9. The carton of claim 8, wherein the carton comprises a handle, the handle comprises a handle panel in the second side panel and the handle panel extends into at least one of the bottom panel and first top panel; and the carton comprises a reinforcing tape that reinforces the handle and the carton.

10. The carton of claim 1 wherein the carton comprises a dispenser panel removably attached to at least one of the bottom panel and first and second side panels.

11. The carton of claim 1, wherein the 3×2 arrangement comprises a first row and a second row of the plurality of inspection features, each of the plurality of inspection features of the first row have a first length and each of the plurality of inspection features of the second row have a second length.

12. A blank for forming a carton for containing at least one article, the blank comprising:

a plurality of panels for forming an interior of a carton formed from the blank, the plurality of panels comprising a top panel, a bottom panel, a first side panel, and a second side panel;

a plurality of end flaps foldably connected to a respective panel of the plurality of panels, the plurality of end flaps being configured to at least partially close an end of the carton formed from the blank; and at least one panel of the plurality of panels comprising a plurality of inspection features for inspecting the at least one article when the carton is formed from the blank, the plurality of inspection features comprises six inspection features arranged in a 3×2 arrangement, and the plurality of inspection features are each sized to extend laterally across approximately half of the at least one panel wherein the plurality of inspection features comprises a removable inspection panel and inspection openings adjacent respective ends of the inspection panel and the top panel comprises a first top panel and a second top panel, the plurality of inspection features being in the second top panel.

13. The blank of claim 12, wherein the plurality of inspection features comprises at least one opening in the at least one panel, the at least one opening is positioned relative to the at least one article when the carton is formed from the blank to allow visual and tactile inspection of the at least one article.

14. The blank of claim 13, wherein the at least one article comprises a plurality of articles, the plurality of inspection features are for inspecting at least two articles of the plurality of articles when the carton is formed from the blank.

15. The blank of claim 14, wherein the plurality of inspection features are for inspecting at least four of the plurality of articles when the carton is formed from the blank.

16. The blank of claim 12, wherein the top panel comprises the plurality of inspection features.

17. The blank of claim 16, wherein the plurality of inspection features comprises a plurality of removable panels removably attached to the top panel at a respective tear line.

18. The blank of claim 17, wherein the plurality of end flaps comprises a first top end flap and a second top end flap, the first top end flap is foldably connected to the top panel along a first fold line, the second top end flap is foldably connected to the top panel along a second fold line; and the plurality of removable panels extend beyond the first fold line and the second fold line.

19. The blank of claim 12, wherein the plurality of inspection features comprises an inspection opening in the first top panel.

20. A method of forming a carton, the method comprising:

obtaining a blank comprising a plurality of panels comprising a top panel, a bottom panel, a first side panel, and a second side panel, at least one panel of the plurality of panels comprising a plurality of inspection features for inspecting the at least one article, the plurality of inspection features comprises six inspection features arranged in a 3×2 arrangement, and the plurality of inspection features are each sized to extend laterally across approximately half of the at least one panel, and wherein the plurality of inspection features comprises a removable inspection panel and inspection openings adjacent respective ends of the inspection panel and the top panel comprises a first top panel and a second top panel, the plurality of inspection features being in the second top panel;

positioning the plurality of panels to at least partially form an interior of the carton;

obtaining a plurality of articles;

placing the plurality of articles in the interior of the carton and positioning at least one article of the plurality of articles for inspection through a respective one of the plurality of inspection features.

21. The method of claim 20, wherein the plurality of inspection features comprises at least one opening in the at least one panel, the positioning the at least one article comprises positioning the at least one article relative the at least one opening to allow visual and tactile inspection to the at least one article.

22. The method of claim 21, wherein the at least one article comprises at least two articles, and the positioning the at least one article comprises positioning the at least two articles relative the at least one opening to allow visual and tactile inspection to the at least two articles.

23. The method of claim 21, wherein the at least one article comprises at least four articles and the positioning the at least one article comprises positioning the at least four articles relative the at least one opening to allow visual and tactile inspection to the at least four articles.

24. The method of claim 20, wherein the plurality of inspection features are in the top panel.

25. The method of claim 24, wherein the plurality of inspection features comprises a plurality of removable panels removably attached to the top panel at a respective tear line and the method comprises removing the removable panels to allow inspection of the articles.

26. The method of claim 25, wherein the blank further comprises a plurality of end flaps, the plurality of end flaps comprises a first top end flap and a second top end flap, the first top end flap is foldably connected to the top panel along a first fold line, the second top end flap is foldably connected to the top panel along a second fold line, and wherein at least partially closing the carton comprises folding the first top end flap to at least partially close a first end of the carton and folding the second top end flap to at least partially close a second end of the carton.

27. The method of claim 20, wherein the blank comprises handle features, the handle comprises a handle panel in the second side panel and the handle panel extends into at least one of the bottom panel and first top panel; and the method comprises forming the handle from the handle features and a reinforcing tape that reinforces the handle and the carton.

* * * * *